US012280469B2

(12) United States Patent
Nodurft et al.

(10) Patent No.: US 12,280,469 B2
(45) Date of Patent: Apr. 22, 2025

(54) WIRELESS ABRASIVE BLASTING REMOTE DEADMAN ASSEMBLY

(71) Applicants: Douglas P. Nodurft, Jefferson, LA (US); Michael Z Sherwood, Houston, TX (US)

(72) Inventors: Douglas P. Nodurft, Jefferson, LA (US); Michael Z Sherwood, Houston, TX (US)

( * ) Notice: Subject to any disclaimer, the term of this patent is extended or adjusted under 35 U.S.C. 154(b) by 166 days.

(21) Appl. No.: 17/357,675

(22) Filed: Jun. 24, 2021

(65) Prior Publication Data

US 2023/0211462 A1 Jul. 6, 2023

(51) Int. Cl.
*B24C 9/00* (2006.01)
*B24C 3/06* (2006.01)

(52) U.S. Cl.
CPC . *B24C 9/00* (2013.01); *B24C 3/06* (2013.01)

(58) Field of Classification Search
CPC .... B24C 9/00; B24C 3/06; B24C 5/02; B24C 5/04; B24C 7/0046; B24C 7/0053; B24C 7/0061; B24C 3/04
USPC ..... 451/102
See application file for complete search history.

(56) References Cited

U.S. PATENT DOCUMENTS 4,135,068 A * 1/1979 Burns ..... B24C 7/00 451/99
4,270,032 A * 5/1981 Dobberpuhl ..... B60K 28/14 200/332
4,926,589 A * 5/1990 Abbott ..... B24C 5/02 451/90
5,024,029 A * 6/1991 Abbott ..... B25F 5/02 451/99
6,752,816 B2 * 6/2004 Culp ..... A61B 17/1626 606/180
8,288,670 B2 * 10/2012 Nguyen ..... B60K 28/14 200/335
2004/0005848 A1 * 1/2004 Yamaharu ..... B24C 1/003 451/91
2006/0011457 A1 * 1/2006 Robertson ..... B24C 5/02 200/51 LM
2007/0181836 A1 * 8/2007 Nguyen ..... F16K 11/048 251/231
2010/0093261 A1 * 4/2010 Seyffert ..... B05B 7/0408 451/38
2018/0130613 A1 * 5/2018 Nguyen ..... H01H 13/506
(Continued)

*Primary Examiner* — Brian D Keller
*Assistant Examiner* — Jason Khalil Hawkins
(74) *Attorney, Agent, or Firm* — Norton IP Law Firm LLC; Taylor M. Norton

(57) ABSTRACT

The present disclosure provides for an abrasive blasting remote assembly having a shroud and a deadman lever pivotally connected to the shroud. The deadman lever is pitoval between a closed operating position and a released position. In the closed operating position, the deadman ever engages a momentary deadman switch disposed within the shroud. The momentary deadman switch is electrically connected to a wireless transmitter circuit board, which sends a wireless operational signal to a blasting pot wireless receiver to activate airflow through a blasting hose from a blasting pot, for the movement of abrasive media through the blasting hose, when the deadman lever depresses the momentary deadman switch in the closed operating position.

11 Claims, 13 Drawing Sheets

(56) References Cited

U.S. PATENT DOCUMENTS

2021/0331290 A1* 10/2021 Mason ..... B24C 7/0046
2022/0379435 A1* 12/2022 Thomas ..... B24C 5/02

* cited by examiner

WIRELESS ABRASIVE BLASTING REMOTE DEADMAN ASSEMBLY

BACKGROUND OF THE INVENTION

Field of the Invention

The present invention generally relates to remote control safety devices and more particularly relates to abrasive blasting remote control safety devices.

Description of the Related Art

Abrasive blasting, which is more commonly known as sandblasting, is the process of forcibly propelling a stream of abrasive particles against a surface under high pressure, in order to smooth a rough surface, to roughen a smooth surface, to remove surface contaminants, or to shape a surface. The blasting material is often called the media, which is propelled through a pressurized fluid, such as compressed air. A centrifugal wheel is sometimes used in lieu of the pressurized fluid.

Various types of media are used in the abrasive blasting process, such media types range from highly abrasive to mildly abrasive. The media with the highest abrasiveness are sand and shot, which contain metal balls or pellets. Glass beads, plastic media (ground-up plastic stock), walnut shells and corn cobs are classified as moderately abrasive media. The mildly abrasive media variants include materials such as baking soda. Finally, ice and dry ice are used as blasting media, which are classified as barely abrasive or non-abrasive.

Specifically, abrasive blasting using highly abrasive material is typically used for the process of smoothing, shaping, and cleaning a hard surface by forcing solid particles across the hard surface at high speeds. This process has a similar effect to that of using sandpaper, however, this variant of abrasive blasting provides a more even finish with no problems at corners or crannies. Aeolian erosion is the result of naturally occurring sandblasting, which typically results from the process of particles blown by wind.

The process of artificial sandblasting was first patented by Benjamin Chew Tilghman on Oct. 18, 1870, being granted U.S. Patent No. 108,408. Sandblasting equipment typically consists of a chamber or blast pot, an air compressor, a hose or blasting line, a nozzle, and a blasting remote. Sandblasting techniques are typically used for cleaning boat hulls, as well as brick, stone, and concrete work. Sandblasting is also often used for cleaning industrial and commercial structures. It is also used for non-metallic workpieces.

Due to the inherent dangers of abrasive blasting, certain safety measures have been developed over the years. Such dangers to operators of blasting equipment include exposure to hazardous dust, potential burns due to projections, which can include skin and eye lesions, slip and falls due to walking on round shot scattered on the ground, heat exhaustion, creation of an explosive atmosphere, and exposure to excessive noise. While many abrasive media used in blasting operations are not hazardous in themselves, such as steel shot and grit, cast iron, aluminum oxide, garnet, plastic abrasive, and glass beads, other abrasive media, such as silica sand, copper slag, and staurolite, have varying degrees of hazard to the operator, such as exposure to free silica or heavy metals. Furthermore, blasting lead-based paint can result in filling the air with lead particles which can be harmful to the nervous system of the operator.

The Occupational Safety and Health Administration (OSHA) mandates engineered solutions to such potential hazards, however silica sand continues to be an acceptable blasting media although the most commonly used blast helmets are not sufficiently effective at protecting the blasting equipment operator if the ambient levels of dust exceed allowable limits. The typical safety equipment for blasting equipment operators include, positive pressure blast hoods or helmets, Grade-D air supplies or self-contained oil-less air pumps, hearing protection, and body protection.

A remote control system is an OSHA required safety device for abrasive blasting operations. Such remote control systems include a control handle, which is often referred to as a dead man switch. The control handle is the trigger for the remote control system, in operation, the blasting equipment operator releases the remote control handle, which deactivates the blasting equipment by stopping the flow of the abrasive material and compressed air through the nozzle.

Over the years, operators of abrasive blasting equipment conventionally utilize pneumatic remote controllers or wired remote controllers to operate the abrasive blasting equipment.

In a typical pneumatic remote control system, when the dead man handle is not compressed by the operator, one stream of air travels down the outbound side of the blasting line and escapes through an opening located under the lever, thus the normally closed inlet valve remains closed and the normally open outlet valve remains open. When the dead man handle lever is pressed, the opening is sealed, and air in the outbound line of the blasting line returns through the inbound line to open the inlet valve and close the outlet valve. This results in the pressurization of the blast machine and initiates the blasting process. The use of pneumatic remote controls work best in blasting operations with a blast hose length of less than 100 feet. However, the use of a pneumatic remote control requires pneumatic lines or hoses be run from the blasting pot to the pneumatic remote control, in addition to the blasting hoses themselves that are already in the field, and those additional pneumatic lines or hoses are undesirable obstacles in the field, including for instance serving as trip hazards. Such additional pneumatic lines or hoses are also subject to damage as well as wear and tear in the field where the sandblasting operations are taking place, which can be costly to replace, when for instance impacted by a freeze, or when run over by equipment or vehicles associated with the sand blasting operations. Accordingly, a need exists for a novel remote control that obviates the need for such additional pneumatic hoses or lines and overcomes the limitation on the working distances or lengths of such pneumatic lines or hoses associated with conventional pneumatic remote controllers.

Wired electrical remote control systems are typically required when the blasting nozzle is 100 feet or farther from the blast machine, because at these distances the delay resulting from pneumatic remote control systems are too great due to the amount of time it takes for the air signal to reach the inlet valve and outlet valves. Instead, electrically wired remote control systems use an electric cord, cable or wire in place of the pneumatic hose to send the signal. The typical electric remote control system uses the electric remote control to send an electric signal through the cord or cable back to a control panel at the blast pot and in turn the control panel then sends a signal of air to the inlet and outlet valves directing them to open or close. With the control panel mounted on the blast pot, some delay in sending the signal is lessened. Electric remote controls are also often used in cold environments due to the issue of pneumatic systems potentially freezing due to the condensation that builds up within the lines. To prevent damp air from freezing, oftentimes an antifreeze injector is installed on all electric control panels. However, the use of a wired remote control requires cords, cable or wires be run from the blasting pot to the wired remote control, in addition to the blasting hoses themselves that are already in the field, and those additional cords, cable or wires are undesirable obstacles in the field, including for instance serving as trip hazards and electrical hazards. Such additional cords, cable or wires are also subject to damage as well as wear and tear in the field where the sandblasting operations are taking place, which can be costly to replace, when for instance damaged by water or impacted or run over by other equipment or vehicles associated with the sand blasting operations. Accordingly, a need exists for a novel remote control that obviates the need for such electrical cords, cables and wires associated with conventional remote controllers.

Although these improvements to technologies have increased the safety of the operators of abrasive blasting equipment, a need exists for wireless blasting remote technology that will help further increase the safety of the operators that implement and use sand blasting technology. While conventional devices may be suitable for the particular purposes employed, they would not be as suitable for the purposes of the present invention as disclosed hereafter. None of such conventional devices disclose the unique structures and advantages of the present disclosure.

Accordingly there is a need for abrasive blasting wireless remote devices that will significantly increase the safety of the user, where such devices are controlled by wireless devices that include failsafe features and allow for the user to activate sand blasting equipment from a safe distance within a protected environment.

As disclosed in this application, the inventor has discovered novel and unique devices and methods for efficiently, effectively, and safely controlling abrasive blasting equipment, which exhibit superlative properties without being dependent on direct connections from the remotes to the blasting pots and without being dependent on complex, immobile, and difficult to use components.

The devices and methods disclosed herein avoid many of the drawbacks of existing methods and devices which rely on expensive complexities, complex tools, or comparatively less safe features for application of control devices for media blasting equipment.

Embodiments of the present invention provide for wireless remote deadman switch controller devices for abrasive blasting equipment and operations as described and defined in the description below and in the annexed claims which provide for improved efficiency and effectiveness characteristics in order to safely control abrasive blasting equipment, in a multitude of environments.

SUMMARY OF THE INVENTION

It is one prospect of the present invention to provide a novel wireless abrasive blasting remote controller deadman switch assembly of simple but effective construction which can be applied to various forms of blasting machines for safe and efficient operation of controlled abrasive blasting equipment.

Another object of the invention is to provide for a wireless remote deadman switch device which is comparatively simple in its construction and arrangement, strong, durable, efficient in its use, readily set up in operative position with respect to abrasive blasting system, and comparatively inexpensive to manufacture. It is also an aim of the present invention to provide an improved remote deadman switch that provides improved ergonomic use and is of economical construction while providing nearly universal fit for intended abrasive blasting equipment, providing for improved efficiency and safety in controlling abrasive blasting equipment, overcoming the complexities and limitations of conventional remote controllers.

The following presents a simplified summary of the present disclosure in a simplified form as a prelude to the more detailed description that is presented herein.

Therefore, to achieve the foregoing and other objects and in accordance with the purposes and embodiments of the present invention, as embodied and described herein, there is provided an abrasive blasting remote assembly comprising a shroud having a shroud cover removably coupled to a shroud base.

The shroud cover defines a depressor aperture which fits a momentary deadman switch, which is a momentary depressor type switch. The shroud base preferably defines at least one button aperture through which each of a switch-on button and a switch-off button respectively extends.

In a preferred embodiment, the shroud base has an elongated concave bottom wall adapted to removably engage a blasting hose. The elongated concave bottom wall has a proximal end opposite a distal end.

In a preferred embodiment, the abrasive blasting remote assembly includes a deadman lever pivotally connected to the shroud cover. The deadman lever has a proximal end opposite a distal end. The distal end of the deadman lever is adapted to be grasped by a hand of a user to pitovally move the deadman lever between a released position and a closed operating position. Preferably, the deadman lever has a deadman switch engaging member on its bottom, facing the shroud.

In one embodiment, a momentary deadman switch is disposed between the shroud cover and the shroud base. The momentary deadman switch preferably has a top depressor button and is sealably fitted within the depressor aperture of the shroud cover. The deadman switch engaging member depresses the momentary deadman switch when the deadman lever is pivoted toward the shroud into the closed operating position. The deadman switch engaging member releases the momentary deadman switch when the deadman lever is pivoted away from the shroud into the released position.

In a preferred embodiment, the abrasive blasting remote assembly comprises a wireless transmitter circuit board disposed within the shroud and electrically connected to the momentary deadman switch. In one embodiment, the wireless transmitter circuit board is adapted to send a wireless operational signal to a blasting pot wireless receiver to activate airflow through the blasting hose from a blasting pot configured for the movement of abrasive media through the blasting hose when the deadman lever depresses the momentary deadman switch in the closed operating position. The wireless transmitter circuit board is adapted to drop the wireless operational signal to the blasting pot wireless receiver, which stops the airflow through the blasting hose, when the deadman lever releases the momentary deadman switch in the released position.

As can been seen, embodiments of the disclosed invention obviate the need for additional pneumatic hoses or lines in the field, as well as obviate the need for wires in the field, thus providing for a safer work environment with less equipment at risk of damage and costly replacement in the field, where the sandblasting operations are taking place.

Moreover, such embodiments of the invention also obviate the need for the transmission of a second signal in order to stop the airflow in the blast hose, and thus they provide for a more efficient system while providing additional safety to the user, the operator.

In another embodiment, the wireless transmitter circuit board is adapted to send a wireless cuttoff signal to the blasting pot wireless receiver to stop the airflow through the blasting hose when the deadman lever releases the momentary deadman switch in the released position.

Preferably, the wireless transmitter circuit board is electrically connected to the switch-on button and the switch-off button. In such embodiment, the wireless transmitter circuit board is configured to send a wireless abrasive-on signal to the blasting pot wireless receiver, to activate a feed of abrasive media from the blasting pot into the blasting hose for abrasive media blasting operations, when the user depresses the switch-on button. The wireless transmitter circuit board is also configured to send a wireless abrasive-off signal to the blasting pot wireless receiver, to stop the feed of abrasive media from the blasting pot into the blasting hose, when the user depresses the switch-off button.

In another embodiment, the wireless transmitter circuit board is configured to drop the wireless abrasive-on signal (rather than send a wireless abrasive-off signal) to the blasting pot wireless receiver, to stop the feed of abrasive media from the blasting pot into the blasting hose for abrasive media blasting operations, when the user depresses the switch-off button.

In a preferred embodiment, the abrasive blasting remote assembly has a battery disposed within the shroud and electrically connected to the wireless transmitter circuit board.

In preferred embodiment, the abrasive blasting remote assembly comprises a spring biased interlock safety switch. Preferably, the spring biased interlock safety switch has a planar body that is pivotally connected to a top surface of the distal end of the elongated concave bottom wall of the shroud base. The spring biased interlock safety switch is biased to extend transversely from the top surface to form an obstruction that prevents the closed operating position of the deadman lever. The spring biased interlock safety switch being pivotable against such bias to clear that obstruction such that the deadman lever can pivot into the closed operating position.

In yet another embodiment, the abrasive blasting remote assembly comprises a blasting pot that has a wireless receiver configured to receive signals from the wireless transmitter circuit board that is within the shroud of the abrasive blasting remote assembly.

In a preferred embodiment, the abrasive blasting remote assembly includes a membrane gasket that is sized and sealably disposed between the shroud cover and the shroud base, to better prevent an entrance of water or moisture into the shroud. Preferably, the membrane gasket defines at least one depressor aperture that is in coaxial alignment with with the depressor aperture of the shroud cover such that the momentary deadman switch protrudes through both, the at least one depressor aperture of the membrane gasket and the at least depressor aperture of the shroud. Preferably, the depressor aperture of the shroud cover and the depressor aperture of the membrane gasket are geometrically aligned and similar in size. The membrane gasket is preferably made of rubber.

In one embodiment, abrasive blasting remote assembly has a light emitting diode (LED) electrically connected to the wireless transmitter circuit board and battery, and the shroud base defines an LED aperture through which the LED extends. Preferably, the LED illuminates when the deadman lever is pivoted into the closed operating position.

In one embodiment, the elongated concave bottom wall of the shroud has a plurality of transversely oriented ribs that are configured to grip the blasting hose when the abrasive blasting remote assembly is connected to it.

In a preferred embodiment, the bottom of the shroud base of the abrasive blasting remote assembly defines a recess, and a plurality of transversely oriented ribs that are configured to grip the blasting hose are disposed within that recess.

Preferably, the proximal end and the distal end of the elongated concave bottom wall of the shroud base each comprise a groove adapted to receive and engage a respective clasp for connecting said abrasive blasting remote assembly to the blasting hose.

In one embodiment of the abrasive blasting remote assembly, the switch-on button is biased by a biasing mechanism to extend outward of the shroud base, and the switch-on button is movable against that bias. When a force of the grasp of the user depresses the switch-on button against the bias, the switch-on button activates the feed of abrasive media from the blasting pot at the option of the user because the wireless transmitter circuit board sends a signal to the blasting pot wireless receiver to activate the feed of abrasive media.

In one embodiment of the abrasive blasting remote assembly, the switch-off button is biased by a biasing mechanism to extend outward of the shroud base, and the switch-off button is movable against that bias. When a force of the grasp of the user depresses the switch-off button against the bias, the switch-off button stops the feed of abrasive media from the blasting pot, at the option of the user. When a force of the grasp of the user depresses the switch-on button against the bias, the switch-on button activates the feed of abrasive media from the blasting pot at the option of the user because the wireless transmitter circuit board sends a signal to the blasting pot wireless receiver to stop the feed of abrasive media.

In one embodiment, the shroud cover defines a plurality of fastener apertures and the shroud base defines a plurality of fastener openings in respective alignment with the plurality of fastener apertures. In such embodiment, the abrasive blasting remote assembly includes threaded fasteners through the respective apertures to removably connect the shroud cover to the shroud base.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which.

DETAILED DESCRIPTION

Figure 1:
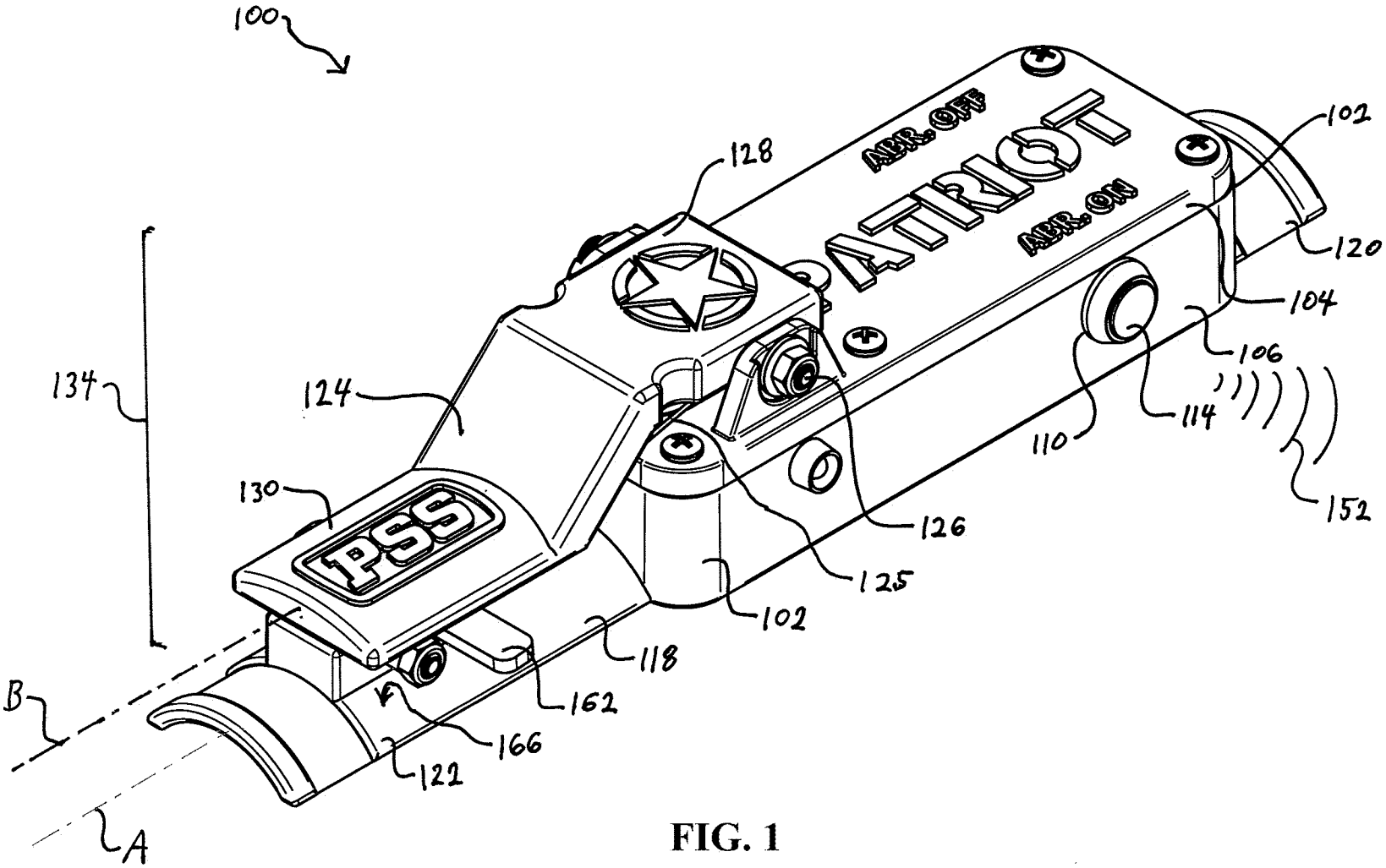
FIG. 1 is a front right perspective view of an exemplary wireless abrasive blasting remote assembly, in accordance with embodiments of the invention.
Figure 2:
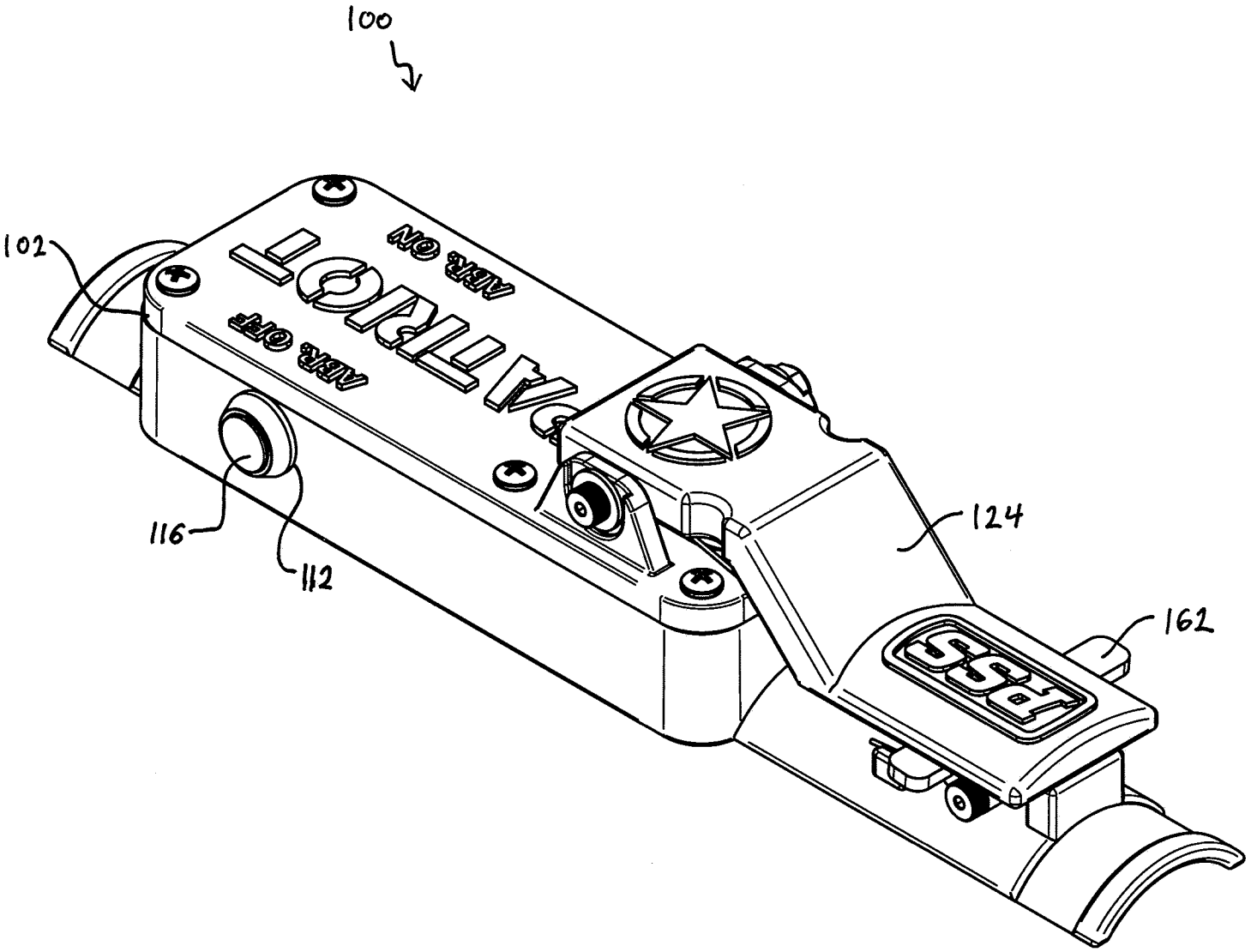
FIG. 2 is a front left perspective view of an exemplary wireless abrasive blasting remote assembly, in accordance with embodiments of the invention.
Figure 3:
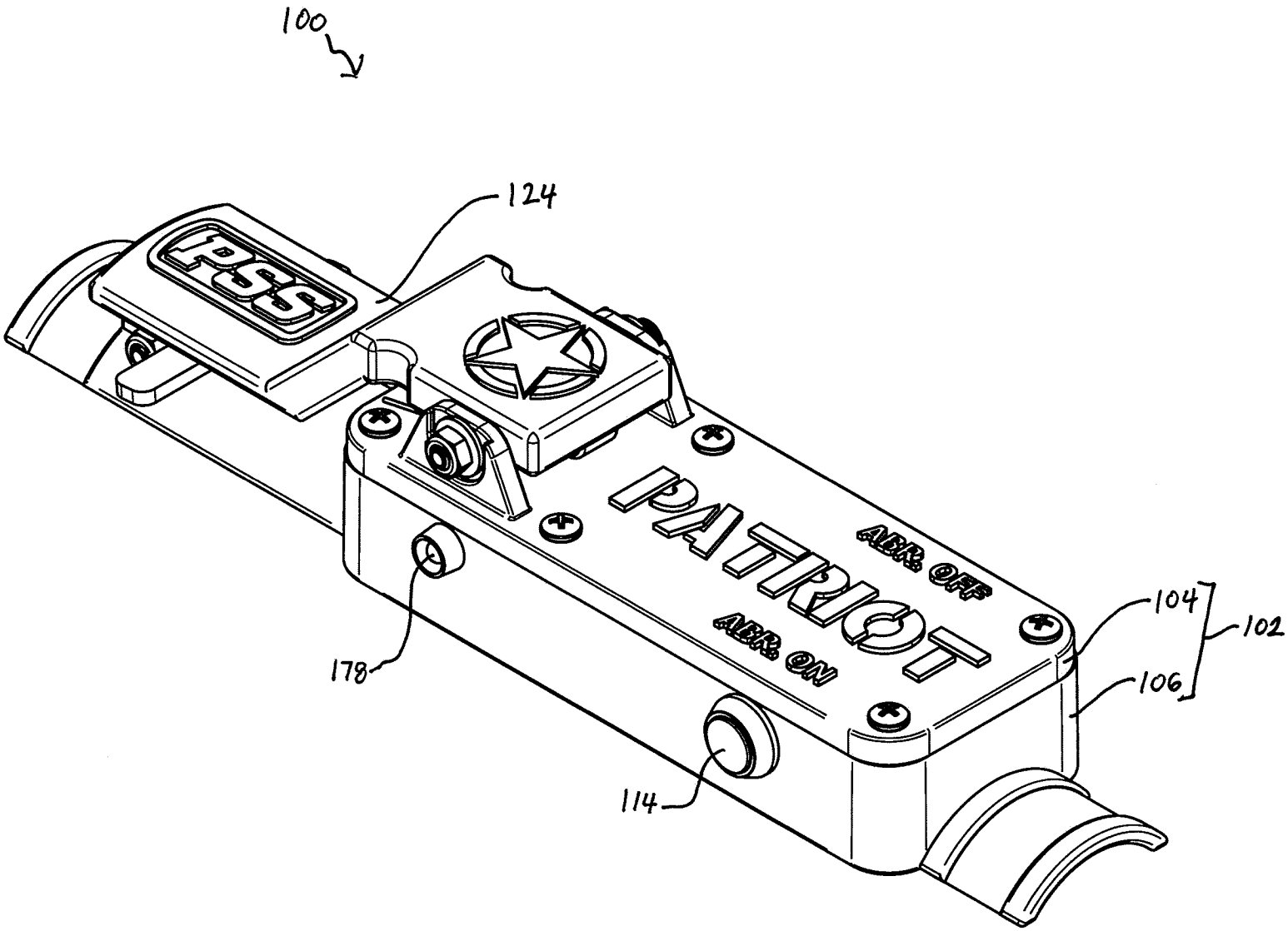
FIG. 3 is a back right perspective view perspective view an exemplary wireless abrasive blasting remote assembly, in accordance with embodiments of the invention.

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

For purposes of clarity and orientation with respect to an object, it is noted that a transverse (also known as axial or horizontal) plane is an X-Z plane, parallel to the ground. A frontal (also known as coronal) plane is a Y-X plane, perpendicular to the object. A lateral plane is an Y-Z plane, perpendicular to the ground, which separates left from right. Objects are coplanar if they all lie in the same plane. For example, one axis is coplanar with another axis when the two axes lie in the same plane.

As used herein, "axis" means a real or imaginary straight line about which a three-dimensional body is symmetrical. A "vertical axis" means an axis perpendicular to the ground (or put another way, an axis extending upwardly and downwardly). A "horizontal axis" means an axis parallel to the ground.

As used herein, homogeneous is defined as the same in all locations, and a homogeneous material is a material of uniform composition throughout that cannot be mechanically separated into different materials. Examples of "homogeneous materials" are certain types of plastics, ceramics, glass, metals, alloys, paper, board, resins, and coatings.

Reference will now be made in detail to the present preferred embodiments of the invention, examples of which are illustrated in the accompanying drawings. Wherever shroud cover 104 possible, the same reference numerals are used in the drawings and the description to refer to the same or like parts.

Referring initially to FIGS. 1-5, the basic constructional details and principles of operation are provided of an abrasive blasting remote assembly 100 comprising a shroud 102 having a shroud cover 104 removably coupled to a shroud base 106. The shroud 102 is preferably constructed of a homogeneous material. The preferred material is metal, plastic, or aluminum.

Figure 5:
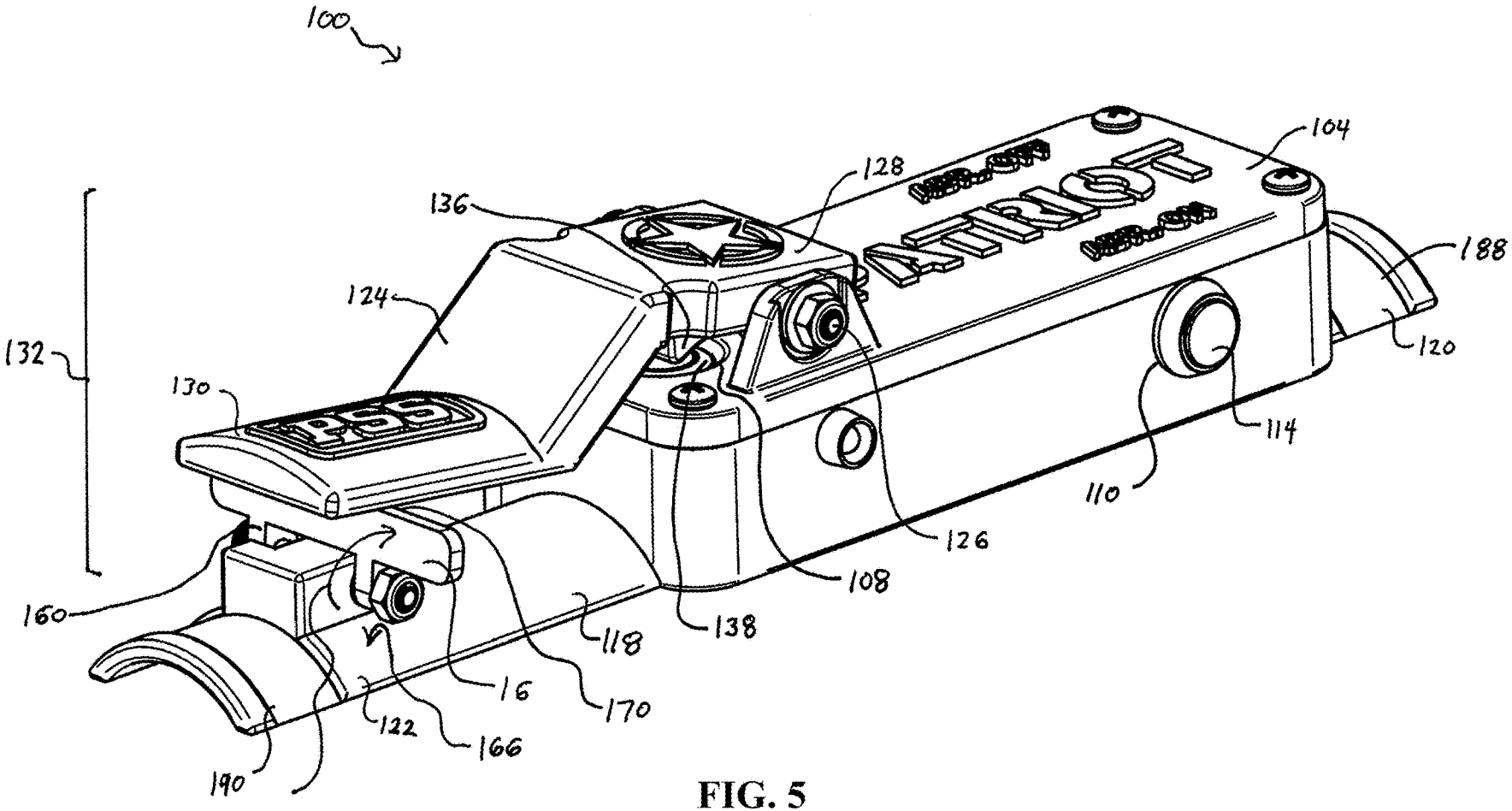
FIG. 5 is another front right perspective view of an exemplary wireless abrasive blasting remote assembly, in accordance with embodiments of the invention.

The shroud cover 104 defines a depressor aperture 108 through which a momentary deadman switch 138 is closely fitted, as illustrated in FIG. 5. Preferably, the momentary deadman switch 138 is in the form of a momentary depressor switch, preferably biased by a spring. The shroud base 106 preferably defines at least one button aperture 110, 112 through which each of a switch-on button 114 and a switch-off button 116 respectively extends.

Figure 6:
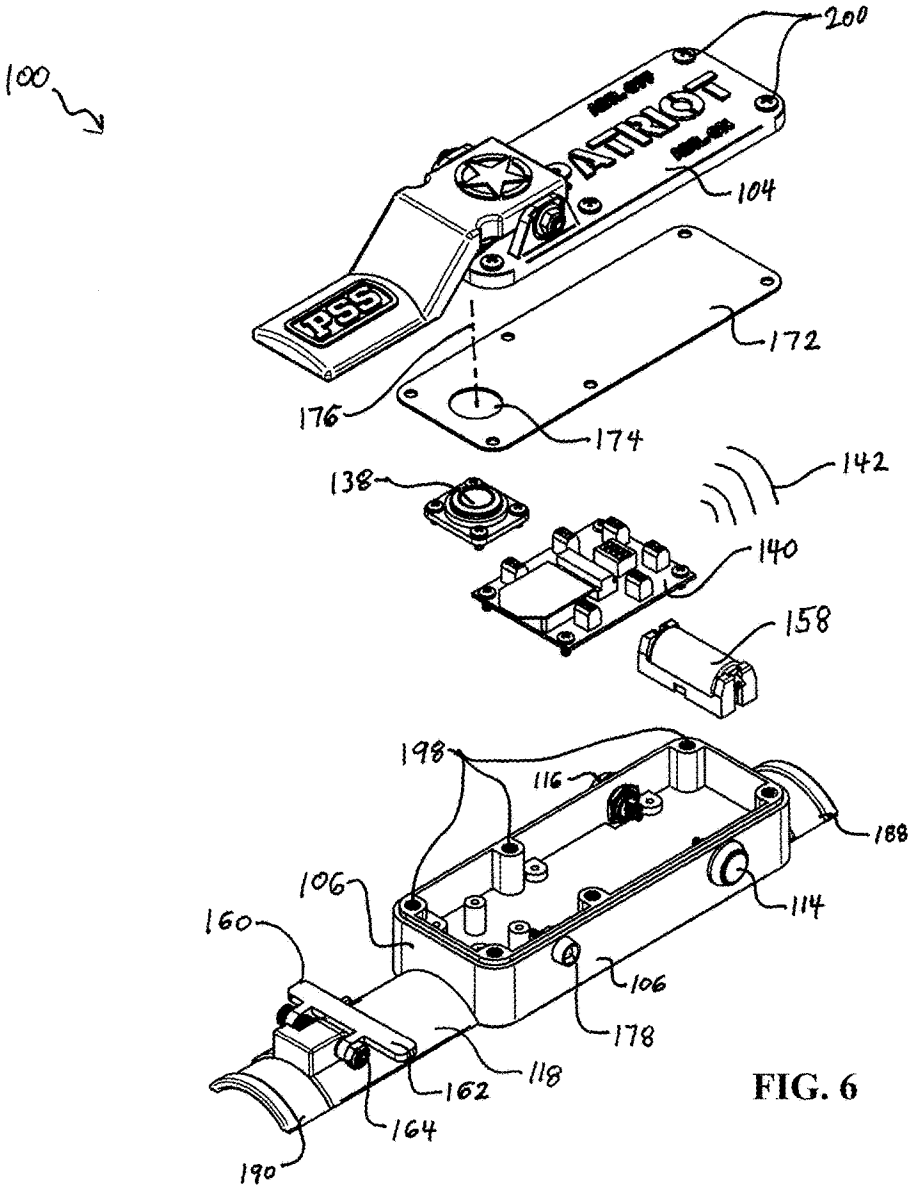
FIG. 6 is a front right perspective exploded view of an exemplary wireless abrasive blasting remote assembly, in accordance with embodiments of the invention.
Figure 11:
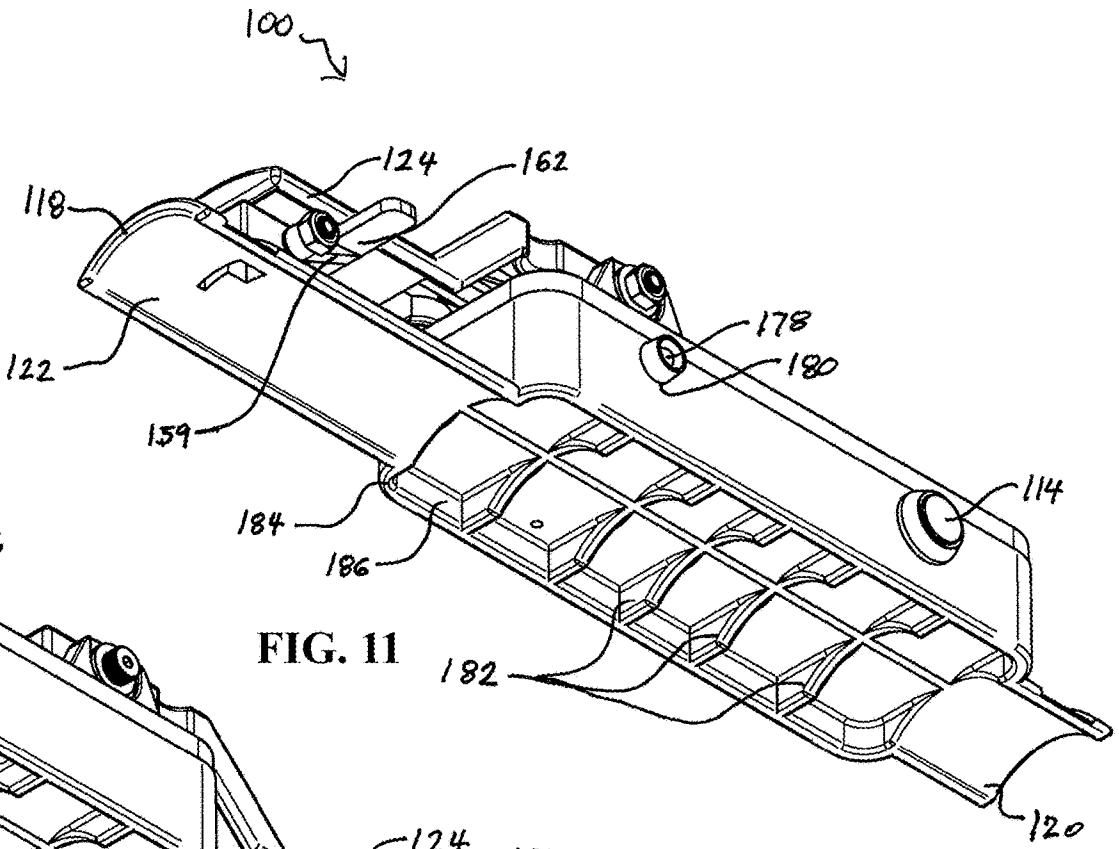
FIG. 11 is a bottom right perspective view of an exemplary wireless abrasive blasting remote assembly, in accordance with embodiments of the invention.
Figure 12:
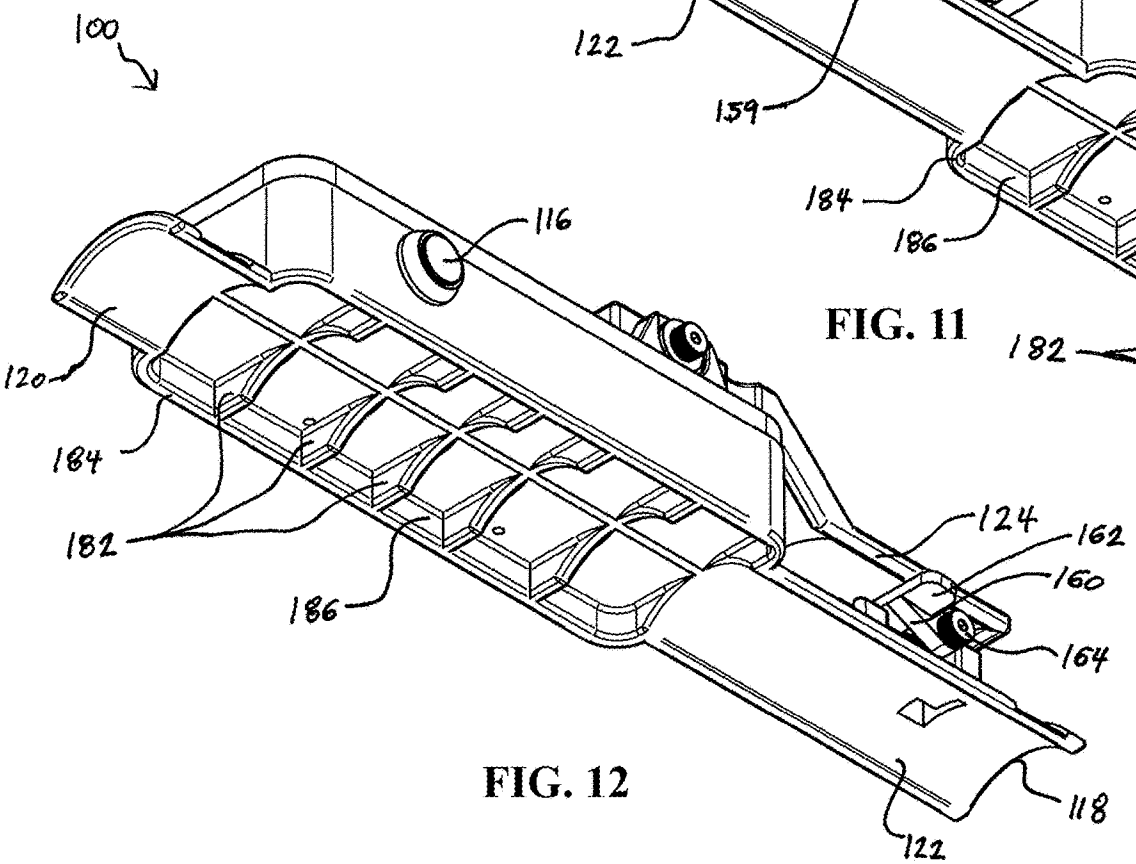
FIG. 12 is a bottom left perspective view of an exemplary wireless abrasive blasting remote assembly, in accordance with embodiments of the invention.
Figure 13:
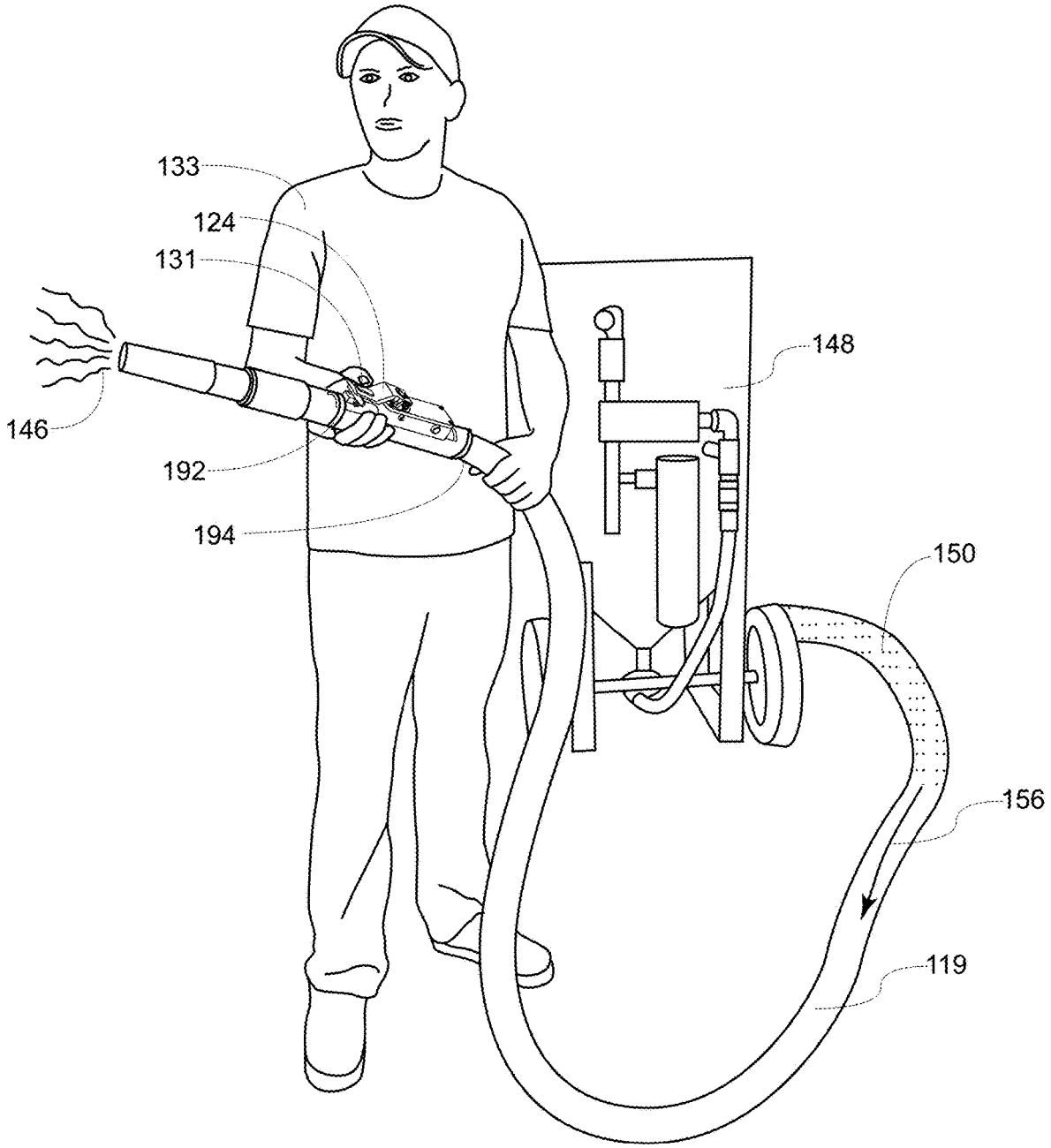
FIG. 13 is a right perspective view of a wireless abrasive blasting remote assembly attached to an exemplary blasting hose connected to an exemplary blasting pot, in accordance with embodiments of the invention.
Figure 14:
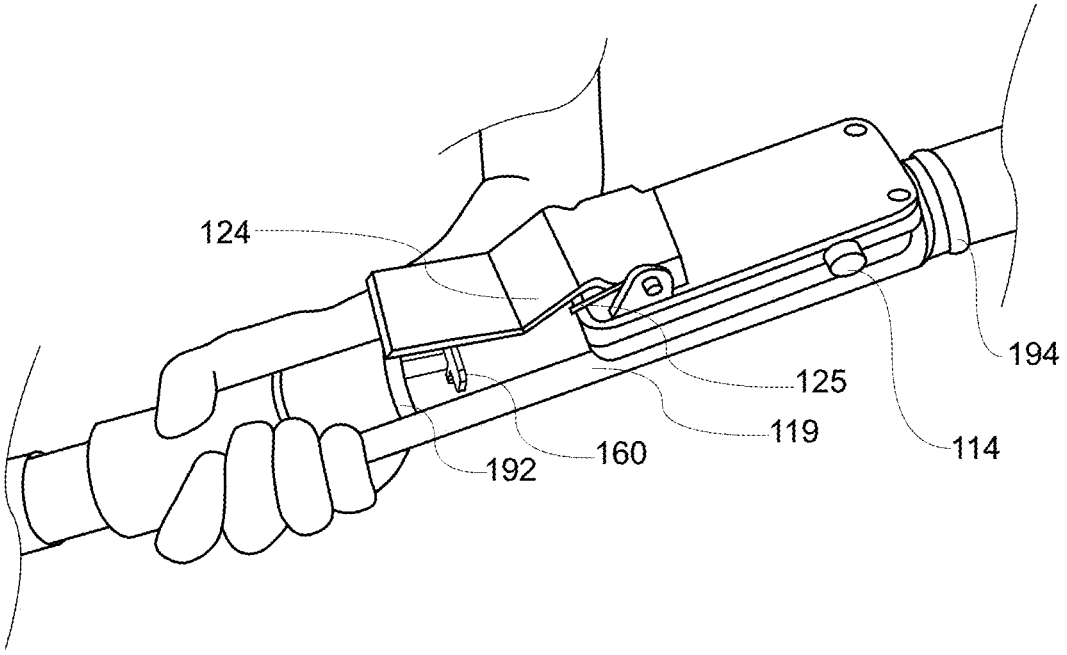
FIG. 14 is a top right perspective view of a wireless abrasive blasting remote assembly attached to an exemplary blasting hose, in accordance with embodiments of the invention.
Figure 15:
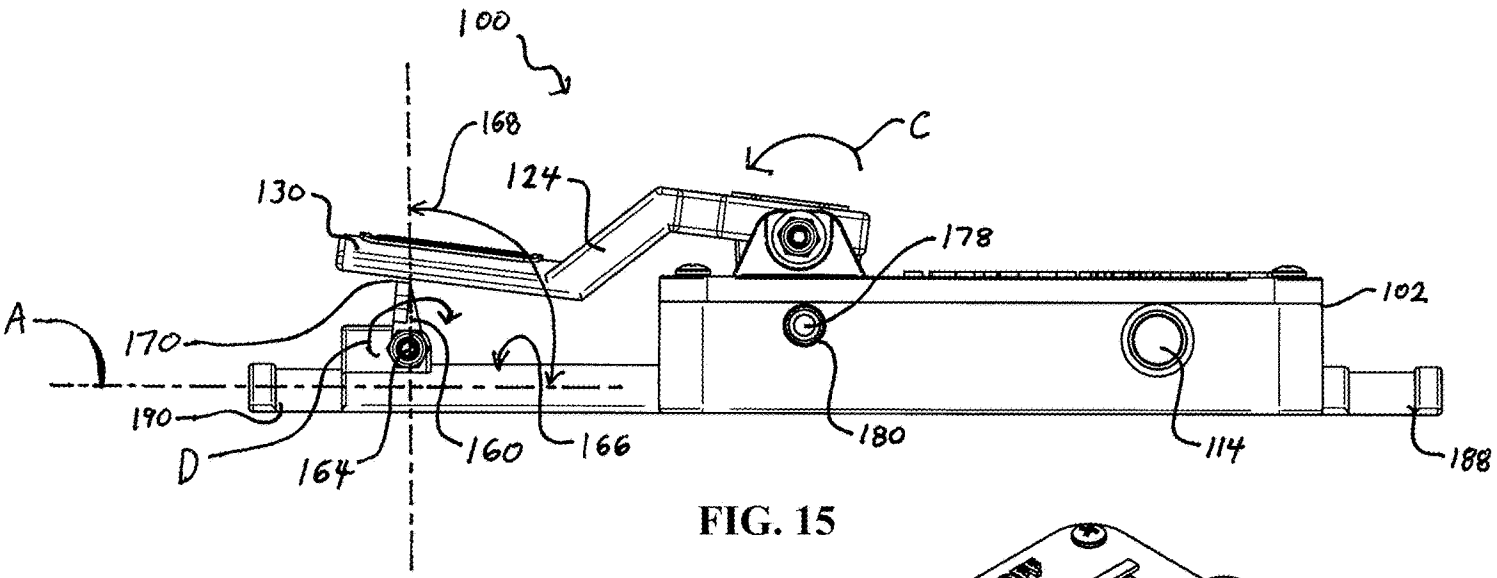
FIG. 15 is a right elevation view of an exemplary wireless abrasive blasting remote assembly, in accordance with embodiments of the invention.
Figure 16:
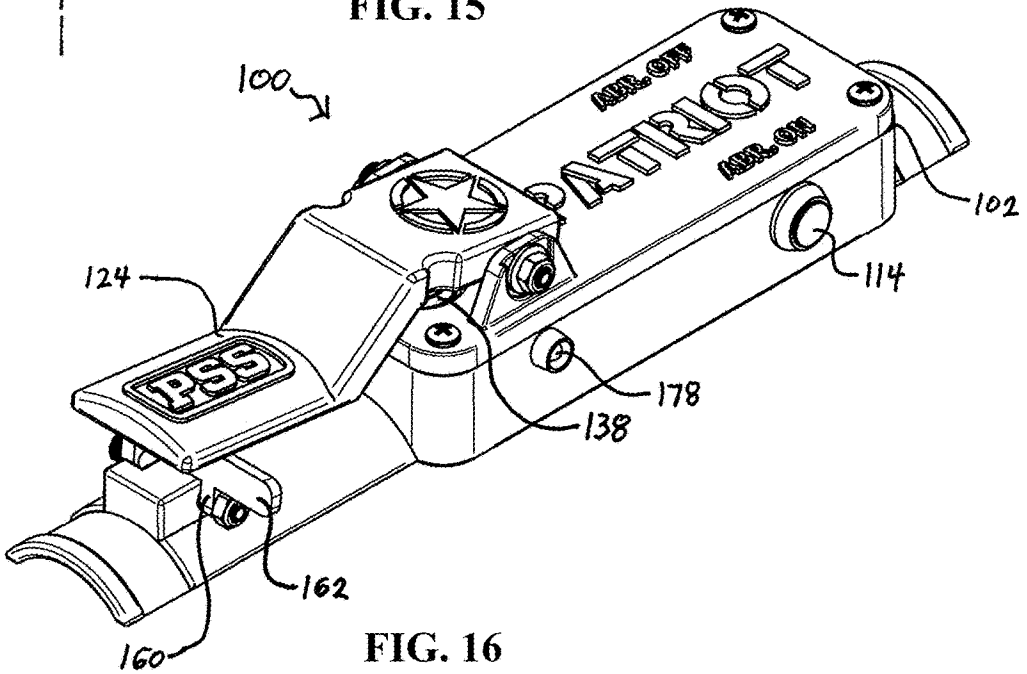
FIG. 16 is a front right perspective view of an exemplary wireless abrasive blasting remote assembly, in accordance with embodiments of the invention.

As seen in FIGS. 6, 11 and 12, in a preferred embodiment, the shroud base 106 has an elongated concave bottom wall 118 adapted to removably engage a blasting hose 119, exemplified in FIGS. 13-14. The elongated concave bottom wall 118 has a proximal end 120 opposite a distal end 122. The distal end 122 has a longitudinal axis A , as illustrated in FIG. 1.

Referring to FIGS. 1- 5, in a preferred embodiment, the abrasive blasting remote assembly 100 includes a deadman lever 124 pivotally connected to the shroud cover 104 with a fulcrum or pin 126 connection. The deadman lever is preferably biased toward a released position 132 with a spring 125 (FIG. 14). The deadman lever 124 has a proximal end 128 opposite a distal end 130. As exemplified in FIG. 13, the distal end 130 of the deadman lever 124 is adapted to be grasped by a hand 131 of a user 133 to pitovally move the deadman lever 124 between a released position 132, as illustrated in FIGS. 5 and 14-16, and a closed operating position 134, as illustrated in FIGS. 1-4, 8-9 and 13.

Figure 8:
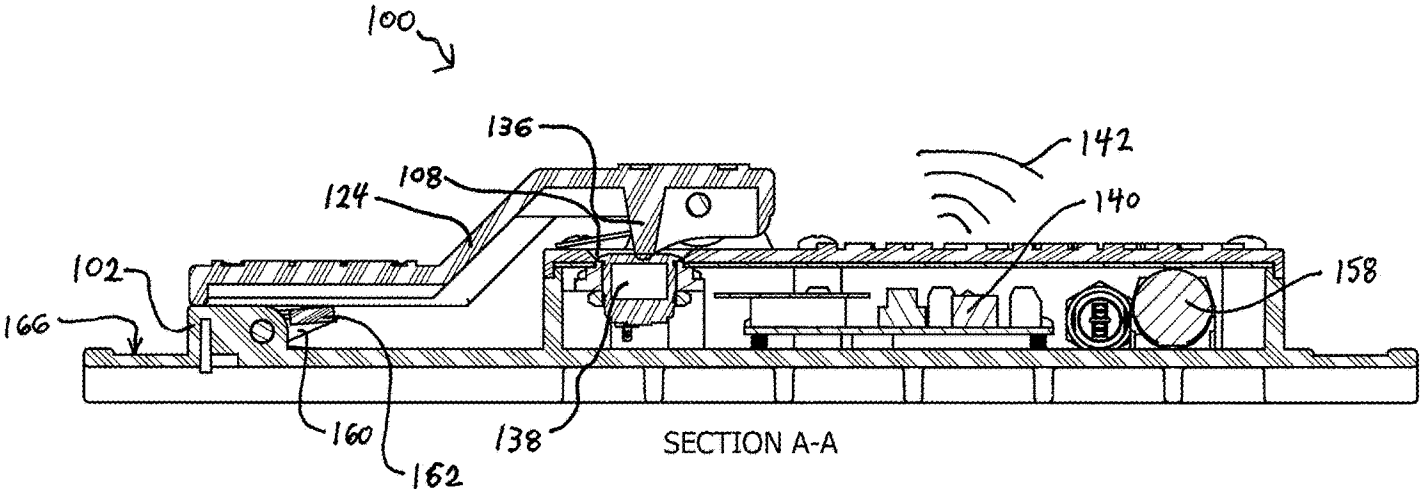
FIG. 8 is a cross-section view an exemplary wireless abrasive blasting remote assembly taken along Line A-A of FIG. 7, in accordance with embodiments of the invention.
Figure 9:
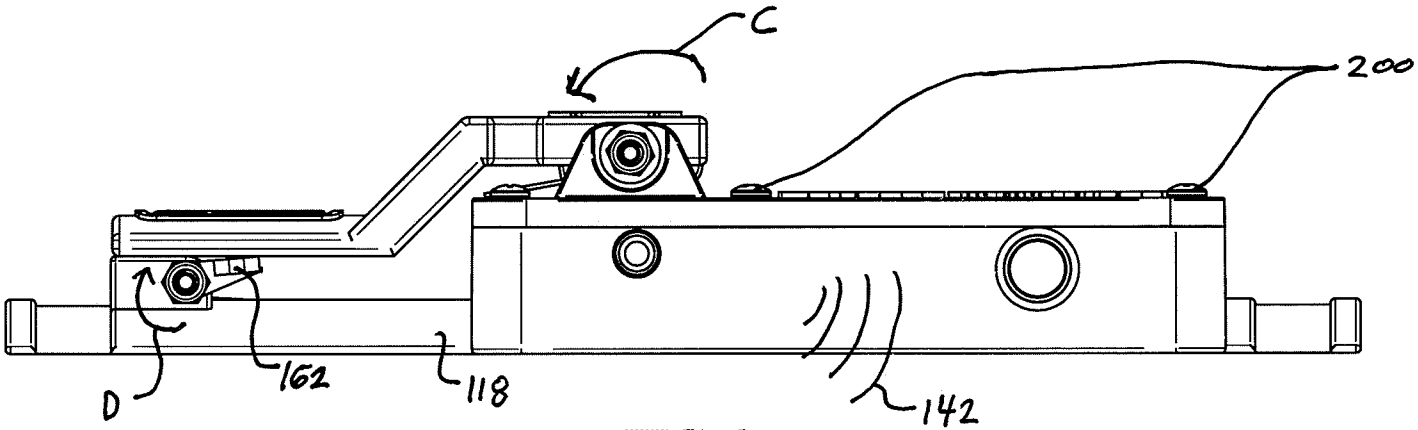
FIG. 9 is a right elevation view of an exemplary wireless abrasive blasting remote assembly, in accordance with embodiments of the invention.

Preferably, the deadman lever 124 has a deadman switch engaging member 136 on its bottom, facing the shroud 102, as illustrated in FIGS. 5 and 8. As can be seen in FIG. 1, the distal end 122 of the elongated concave bottom wall 118 has a longitudinal axis A which is oriented substantially parallel to a longitudinal axis B of the distal end 130 of the deadman lever 124 when the abrasive blasting remote assembly 100 is in a closed operating position 134.

In one embodiment, as illustrated in FIG. 6, the momentary deadman switch 138 is disposed between the shroud cover 104 and the shroud base 106. The momentary deadman switch 138 preferably has a top depressor button and is sealably fitted within the depressor aperture 108 of the shroud cover 104, as seen in FIGS. 5 and 8. The deadman switch engaging member 136 depresses the momentary deadman switch 138 (into the depressor aperture 108) when the deadman lever 124 is pivoted toward the shroud 102 into the closed operating position 134, as illustrated in FIGS. 1-4 and FIGS. 8-9. The deadman switch engaging member 136 releases the momentary deadman switch 138 when the deadman lever 124 is pivoted away from the shroud 102 into the released position 132.

In a preferred embodiment, the abrasive blasting remote assembly 100 comprises a wireless transmitter circuit board 140 disposed within the shroud 102 and electrically connected to the momentary deadman switch 138, as illustrated in the exploded view on FIG. 6.

Figure 17:
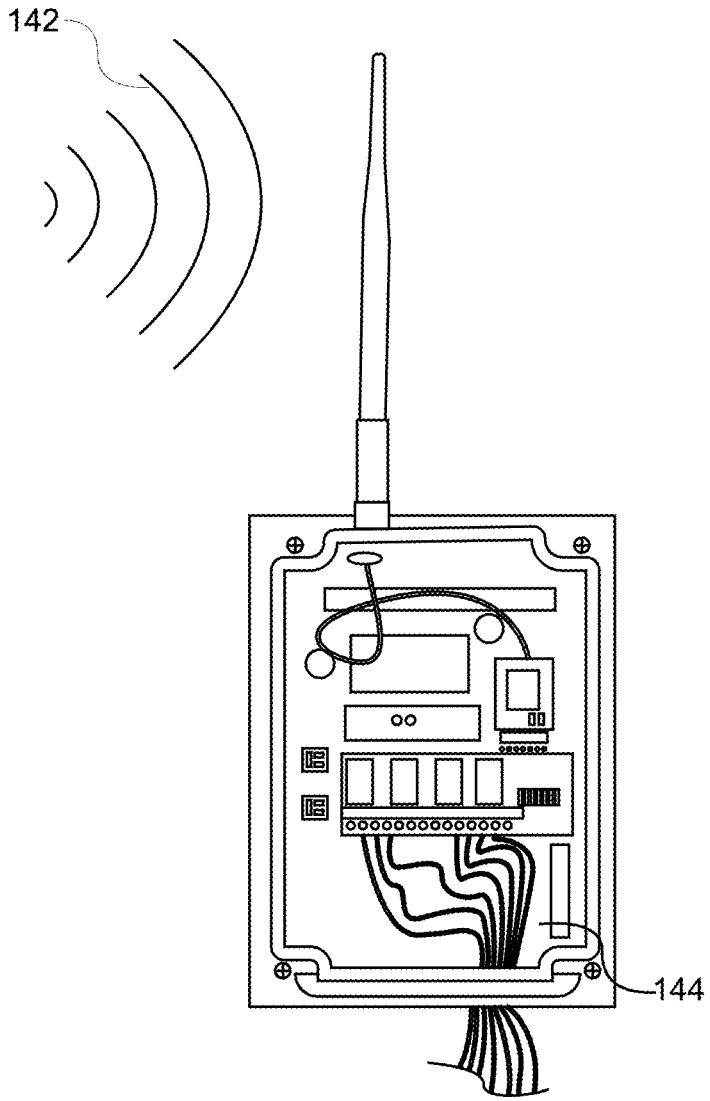
FIG. 17 is a front elevation view of an exemplary wireless blasting pot receiver, in accordance with embodiments of the invention.

In one embodiment, referring to FIGS. 13 and 17, the wireless transmitter circuit board 140 is adapted to send a wireless operational signal 142 to a blasting pot 148 wireless receiver 144 to activate airflow 146 through the blasting hose 119 from a blasting pot 148 for the movement of abrasive media 150 through the blasting hose 119 when the deadman lever 124 depresses the momentary deadman switch 138 in the closed operating position 134.

As illustrated in FIG. 1, when the longitudinal axis A of the distal end 122 of the elongated concave bottom wall 118 is oriented substantially parallel to the longitudinal axis B of the distal end 130 of the deadman lever 124, then the abrasive blasting remote assembly 100 is in a closed operating position 134, such that the deadman switch engaging member 136 depresses the momentary deadman switch 138, which triggers the wireless transmitter circuit board 140 to send the wireless operational signal 142 to the wireless receiver 144 of the blasting pot 148 to activate the flow of air 146 (FIG. 13) through the blasting hose 119 for the movement of abrasive media 150 through the blasting hose 119 during abrasive blasting operations.

Preferably, the wireless transmitter circuit board 140 is adapted to drop (i.e., de-energize) the wireless operational signal 142 to the blasting pot wireless receiver 144, which stops the airflow 146 through the blasting hose 119, when the deadman lever 124 releases the momentary deadman switch 138 in the released position 132. The wireless operational signal 142 is preferably a radio frequency (RF) signal. In one embodiment, the wireless transmitter circuit board 140 is connected to a relay shield.

As can been appreciated from a review of embodiments of the disclosure herein, the disclosed invention obviates the need for conventional pneumatic hoses or lines in the field, as well as obviate the need for conventional wires in the field, while providing for an work efficient and cost efficient solution for a deadman controller for sandblasting operations, and while embodiments of the invention provide for a safer work environment with less equipment at risk of damage and costly replacement in the field where the sandblasting operations are taking place.

In a preferred embodiment, when the deadman lever 124 is in the closed position such that the deadman switch engaging member 136 is depressing the momentary deadman switch 138, there is a maintained momentary relay configuration of the "deadman" stop input that is always transmitting from the wireless transmitter circuit board 140 to the blasting pot wireless receiver 144. So if the abrasive blasting remote assembly 100 is accidentally dropped by a user 133, then the deadman lever 124 is pivoted (as further explained below) into the released position 132 and thus the monetary deadman switch is released, and the switch is opened causing the relay between the wireless transmitter circuit board 140 and the blasting pot wireless receiver 144 to de-energize. When the relay de-energizes, the blasting pot wireless receiver 144 does not receive the wireless operational signal 142, and thus, no airflow 146 is activated through the blasting hose 119. In other words, when the relay de-energizes, the airflow 146 stops, which occurs automatically when the deadman lever 124 releases the momentary deadman switch 138, in the released position 132. This same relay will de-energize if the wireless operational RF signal 142 is out of range between the wireless transmitter circuit board 140 and the blasting pot wireless receiver 144, if the wireless transmitter circuit board 140 loses power, and/or if the blasting pot wireless receiver 144 loses power. When the relay de-energizes, the airflow 146 stops automatically. Accordingly, through embodiments of the invention disclosed herein, the abrasive blasting remote assembly 100 is inherently safe. No additional signals are required to achieve such safe operation. Accordingly, embodiments of the invention obviate the need for the transmission of a second signal from the remote control to the blasting pot in order to stop the airflow in the blast hose, and thus they provide for a more efficient system while providing additional safety to the user, the operator 133.

In another embodiment, the wireless transmitter circuit board 140 is adapted to send a wireless cuttoff signal to the blasting pot wireless receiver 144 to stop the airflow 146 through the blasting hose 119 when the deadman lever 124 releases the momentary deadman switch 138 in the released position 132 132.

Figure 7:
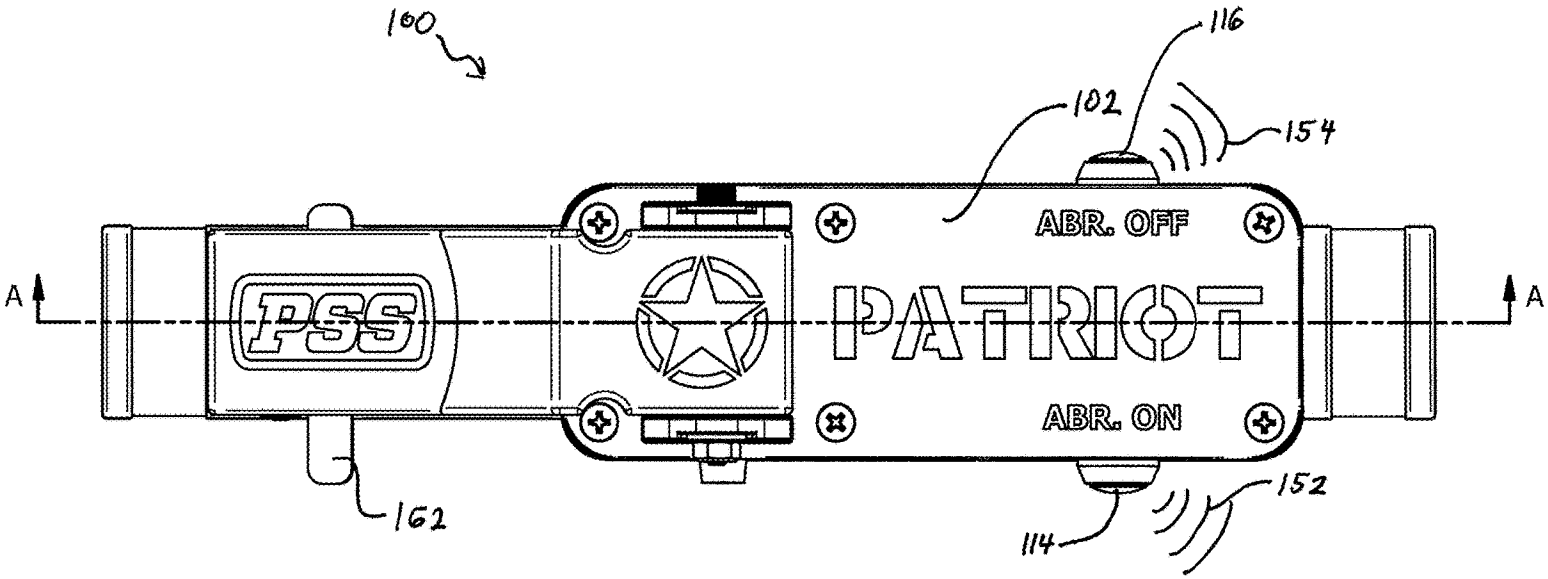
FIG. 7 is a top view of an exemplary wireless abrasive blasting remote assembly, in accordance with embodiments of the invention.

Preferably, referring to FIG. 7, the wireless transmitter circuit board 140 is electrically connected to the switch-on button 114 and the switch-off button 116. In such embodiment, the wireless transmitter circuit board 140 is configured to send a wireless abrasive-on signal 152 to the blasting pot wireless receiver 144, to activate a feed of abrasive media 150 from the blasting pot 148 into the blasting hose 119 for abrasive media 150 blasting operations, when the user 133 depresses the switch-on button 114. The wireless transmitter circuit board 140 is also configured to send a wireless abrasive-off signal 154 to the blasting pot wireless receiver 144 (FIG. 7), to stop the feed of abrasive media 150 from the blasting pot 148 into the blasting hose 119, when the user 133 depresses the switch-off button 116.

In another embodiment, the wireless transmitter circuit board 140 is configured to drop the wireless abrasive-on 152 signal (rather than send a wireless abrasive-off signal 154) to the blasting pot wireless receiver 144, to stop the feed 156 (see illustrative directional arrow in FIG. 13) of abrasive media 150 from the blasting pot 148 into the blasting hose 119 for abrasive media blasting operations, when the user 133 depresses the switch-off button 116.

Referring to FIGS. 6 and 8, in a preferred embodiment, the abrasive blasting remote assembly 100 has a battery 158 disposed within the shroud 102 and electrically connected to the wireless transmitter circuit board 140.

In preferred embodiment, the abrasive blasting remote assembly 100 comprises a spring 159 biased interlock safety switch 160, as exemplified in at least FIGS. 5-12. Preferably, the spring biased interlock safety switch 160 has a planar body 162 that is pivotally connected with a fulcrum or pin 164 connection to a top surface 166 of the distal end 122 of the elongated concave bottom wall 118 of the shroud base 106.

Figure 4:
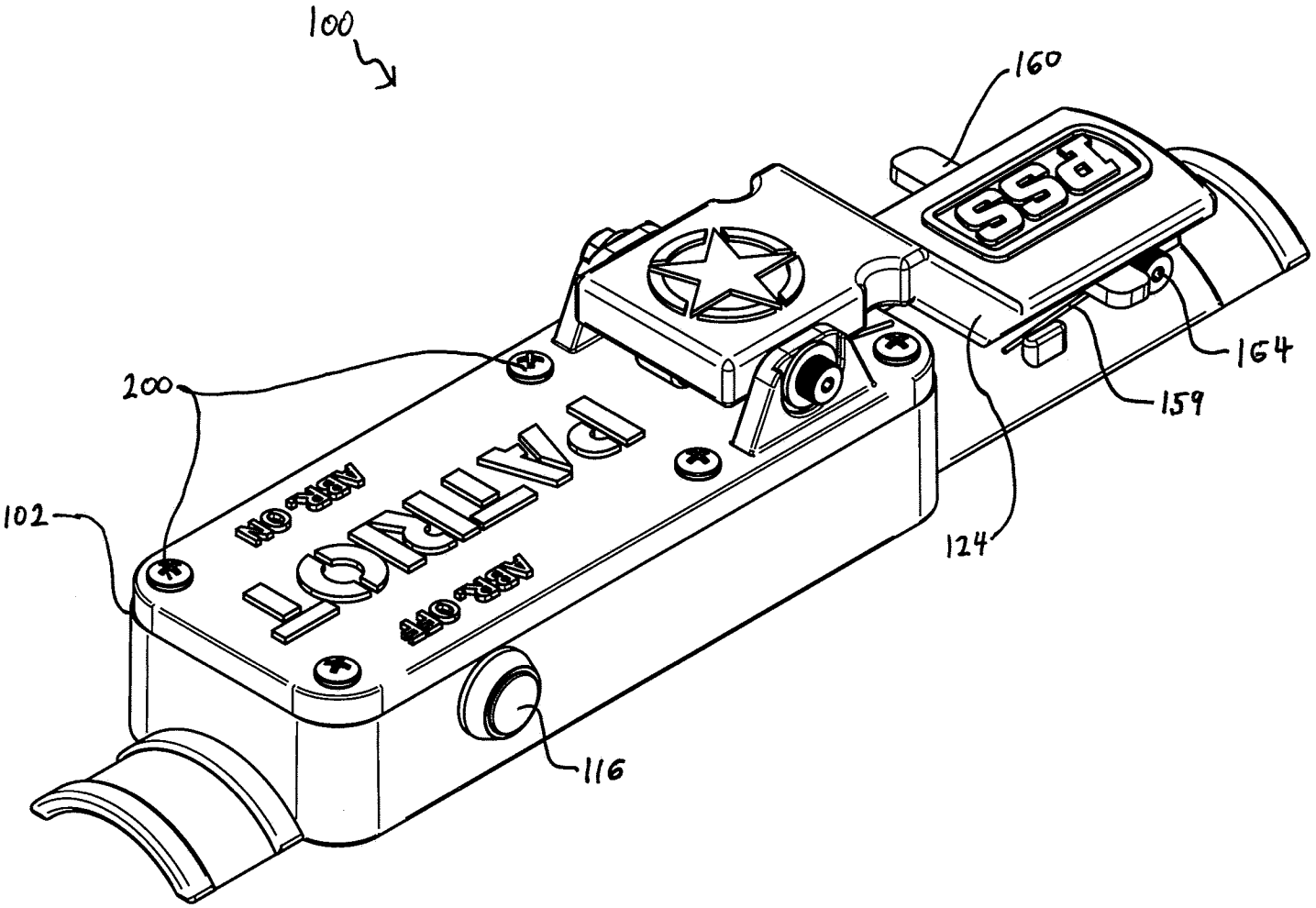
FIG. 4 is a back left perspective view thereof.

The spring biased interlock safety switch 160 is biased (preferably by a biasing mechanism such as a spring 159 as seen in FIGS. 4 and 11) to extend transversely 168 from the top surface 166 to form an obstruction 170 (FIG. 5) that prevents the closed operating position 134 of the deadman lever 124. The spring biased interlock safety switch 160 is pivotable against such bias (in the direction of Arrow D in FIGS. 5, 9 and 15) to clear that obstruction 170 , at the option of the user 133, such that the deadman lever 124 can pivot (in the direction of Arrow C in FIGS. 9 and 15) into the closed operating position 134 illustrated in FIGS. 1-4 and 8-9, such as when a desired force is applied to the spring biased interlock safety switch 160 by the user 133.

Referring to FIGS. 13 and 17, in yet another embodiment, the abrasive blasting remote assembly 100 comprises a blasting pot 148 that has a wireless receiver 144 configured to receive signals (e.g., 142, 152, 154) from the wireless transmitter circuit board 140 that is disposed 134 within the shroud 102 of the abrasive blasting remote assembly 100.

In a preferred embodiment, the abrasive blasting remote assembly 100 includes a membrane gasket 172 (FIG. 6) that is sized and sealably disposed between the shroud cover 104 and the shroud base 106, to better prevent an entrance of water or moisture into the shroud 102. The membrane gasket 172 transmits force or pressure and acts as a seal between the fixed parts of the shroud cover 104 and the shroud base 106 when they are connected together.

Preferably, the membrane gasket 172 defines at least one depressor aperture 174 that is in coaxial alignment 176 with the depressor aperture 108 of the shroud cover 104 such that the momentary deadman switch 138 protrudes through both, the at least one depressor aperture 174 of the membrane gasket 172 and the at least depressor aperture 108 of the shroud 102. Preferably, the depressor aperture 108 of the shroud cover 104 and the depressor aperture 108 of the membrane gasket 172 are geometrically aligned and similar in size. The membrane gasket 172 is preferably made of rubber.

In one embodiment, abrasive blasting remote assembly 100 has a light emitting diode (LED) 178 electrically connected to the wireless transmitter circuit board 140 and battery 158, and the shroud base 106 defines an LED aperture 180 through which the LED 178 extends. Preferably, the LED 178 illuminates when the deadman lever 124 is pivoted into the closed operating position 134.

Figure 10:
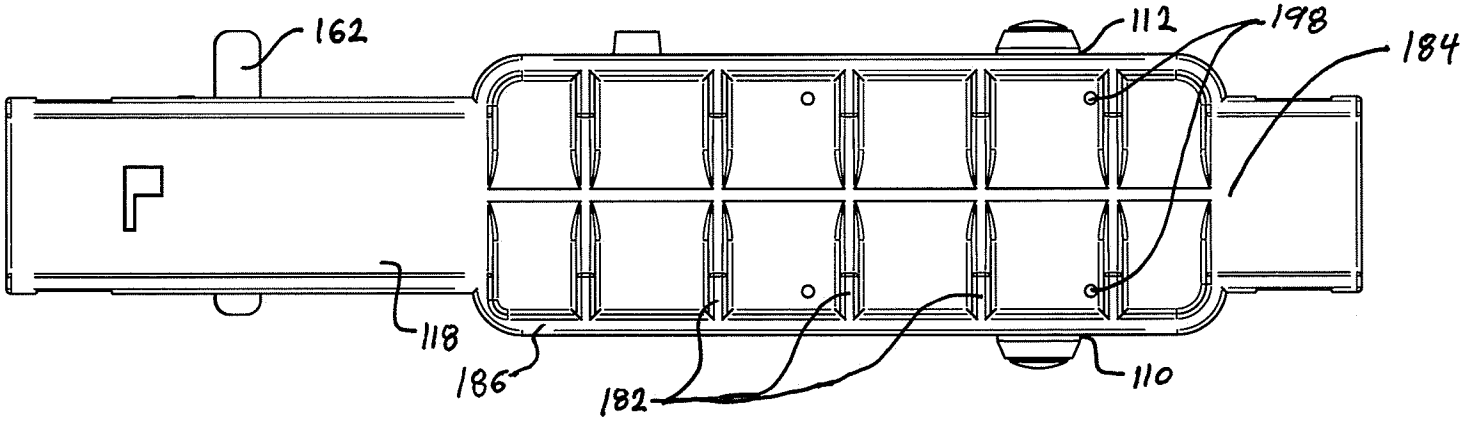
FIG. 10 is a bottom view of an exemplary wireless abrasive blasting remote assembly, in accordance with embodiments of the invention.

In one embodiment, referring to FIGS. 10-12, the elongated concave bottom wall 118 of the shroud 102 has a plurality of transversely oriented ribs 182 that are configured to grip the blasting hose 119 when the abrasive blasting remote assembly 100 is connected to it.

In a preferred embodiment, the bottom 184 of the shroud base 106 of the abrasive blasting remote assembly 100 defines a recess 186, and a plurality of transversely oriented ribs 182 that are configured to grip the blasting hose 119 are disposed within that recess 186.

Preferably, the proximal end 120 and the distal end 122 of the elongated concave bottom wall 118 of the shroud base 106 each comprise a groove 188, 190 adapted to receive and engage a respective clasp 192, 194 for connecting said abrasive blasting remote assembly 100 to the blasting hose 119.

In one embodiment of the abrasive blasting remote assembly 100, the switch-on button 114 is biased by a biasing mechanism to extend outward of the shroud base 106, and the switch-on button 114 is movable against that bias. When a force of the grasp of the user 133 depresses the switch-on button 114 against the bias, the switch-on button 114 activates the feed of abrasive media 150 from the blasting pot 148 at the option of the user 133 because the wireless transmitter circuit board 140 sends a signal to the blasting pot wireless receiver 144 to activate the feed of abrasive media 150.

In yet another embodiment of the abrasive blasting remote assembly 100, the switch-off button 116 is biased by a biasing mechanism to extend outward of the shroud base 106, and the switch-off button 116 is movable against that bias. When a force of the grasp of the user 133 depresses the switch-off button against the bias, the switch-off button 116 stops the feed of abrasive media 150 from the blasting pot 148, at the option of the user 133. When a force of the grasp of the user 133 depresses the switch-off button 116 against the bias, the switch-off button 116 stops the feed of abrasive media 150 from the blasting pot 148 at the option of the user 133 because the wireless transmitter circuit board 140 sends a signal to the blasting pot wireless receiver 144 to stop the feed of abrasive media 150.

In a preferred embodiment, the shroud cover 104 defines a plurality of fastener apertures 196 and the shroud base 106 defines a plurality of fastener openings 198 in respective alignment with the plurality of fastener apertures 196. In such embodiment, the abrasive blasting remote assembly 100 includes threaded fasteners 200 through the respective apertures to removably connect the shroud cover 104 to the shroud base 106.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The claimed invention is:

1. An abrasive blasting remote assembly, comprising:

a shroud having a shroud cover removably coupled to a shroud base, the shroud cover defining a depressor aperture, the shroud base defining at least one button aperture through which a switch-on button extends, the shroud base having a bottom wall adapted to removably engage a blasting hose, the bottom wall having a proximal end opposite a distal end;

a deadman lever pivotally connected to the shroud cover, the deadman lever having a proximal end and a distal end, the distal end adapted to be grasped by a hand of a user to pitovally move the deadman lever between a released position and a closed operating position, the deadman lever having a deadman switch engaging member;

a momentary deadman switch disposed between the shroud cover and the shroud base, the momentary deadman switch sealably fitted within the depressor aperture, wherein the deadman switch engaging member depresses the momentary deadman switch when the deadman lever is in the closed operating position, wherein the deadman switch engaging member releases the momentary deadman switch when the deadman lever is in the released position;

a wireless transmitter circuit board disposed within the shroud and electrically connected to the momentary deadman switch, wherein the wireless transmitter circuit board is adapted to send a wireless operational signal to a blasting pot wireless receiver to activate airflow through the blasting hose from a blasting pot configured for the movement of abrasive media through the blasting hose when the deadman lever depresses the momentary deadman switch in the closed operating position, wherein the wireless transmitter circuit board is adapted to drop the wireless operational signal to the blasting pot wireless receiver to stop the airflow through the blasting hose when the deadman lever releases the momentary deadman switch in the released position; wherein, the wireless transmitter circuit board is electrically connected to the switch-on button, wherein the wireless transmitter circuit board is adapted to send a wireless abrasive-on signal to the blasting pot wireless receiver to activate a feed of abrasive media from the blasting pot into the blasting hose adapted for abrasive media blasting operations when the user depresses the switch-on button;

a battery electrically connected to the wireless transmitter circuit board and disposed between the shroud cover and the shroud base;

a spring biased interlock safety switch having a planar body pivotally connected to a top surface of the distal end of the bottom wall of the shroud base, said spring biased interlock safety switch biased to extend transversely from the top surface to form an obstruction to the closed operating position of the deadman lever, said spring biased interlock safety switch being pivotable against such bias to clear said obstruction.

2. The abrasive blasting remote assembly of claim 1, further comprising the blasting pot having the wireless receiver adapted to receive signals from the wireless transmitter circuit board.

3. The abrasive blasting remote assembly of claim 1, further comprising a membrane gasket sized and sealably disposed between the shroud cover and the shroud base, wherein the membrane gasket defines at least one depressor aperture in coaxial alignment with the depressor aperture of the shroud cover.

4. The abrasive blasting remote assembly of claim 1, further comprising an LED electrically connected to the wireless transmitter circuit board, wherein the shroud base defines an LED aperture through which the LED extends.

5. The abrasive blasting remote assembly of claim 1, wherein the bottom wall further comprises a plurality of transversely oriented ribs configured to grip the blasting hose.

6. The abrasive blasting remote assembly of claim 1, wherein a bottom of the shroud base defines a recess comprising a plurality of transversely oriented ribs configured to grip the blasting hose.

7. The abrasive blasting remote assembly of claim 1, wherein the proximal end and the distal end of the bottom wall of the shroud base each define a groove adapted to receive and engage a respective clasp for connecting the abrasive blasting remote assembly to the blasting hose.

8. The abrasive blasting remote assembly of claim 1, wherein the switch-on button is biased by a biasing mechanism to extend outward of said shroud base, said switch-on button being movable against such bias and adapted to activate the feed of abrasive media from the blasting pot at the option of the user.

9. The abrasive blasting remote assembly of claim 1, the shroud base further defining a button aperture through which a switch-off button extends, wherein the switch-off button is biased by a biasing mechanism to extend outward of said shroud base, said switch-off button being movable against such bias and adapted to stop the feed of abrasive media from the blasting pot at the option of the user.

10. The abrasive blasting remote assembly of claim 1, wherein the shroud cover defines a plurality of fastener apertures and the shroud base defines a plurality of fastener openings, wherein the plurality of fastener apertures align with the respective plurality of fastener openings, and wherein the plurality of fastener apertures and the plurality of fasteners opening are adapted for receipt of threaded fasteners for removably coupling the shroud cover to the shroud base.

11. The abrasive blasting assembly of claim 1, wherein the shroud base bottom wall is elongate and concave.

* * * * *